US006158224A

United States Patent [19]

Hu et al.

[11] Patent Number: 6,158,224

[45] Date of Patent: Dec. 12, 2000

[54] BEVERAGE DISPENSER WITH A DEHUMIDIFIER UTILIZING A THERMOELECTRIC COOLER

[75] Inventors: Ruguo Hu, New Milford; Elaine Wedral, Sherman, both of Conn.

[73] Assignee: Nestec S.A., Vevey, Switzerland

[21] Appl. No.: 09/311,289

[22] Filed: May 14, 1999

[51] Int. Cl.[7] ..... F25B 21/02

[52] U.S. Cl. ..... 62/3.4; 62/3.62

[58] Field of Search ..... 62/3.4, 3.64

[56] References Cited

U.S. PATENT DOCUMENTS

| | | | |
|---|---|---|---|
| 3,651,660 | 3/1972 | Quiros | 62/279 |
| 4,321,800 | 3/1982 | Gifford, Jr. | 62/150 |
| 4,586,342 | 5/1986 | Morishita et al. | 62/3 |
| 4,712,382 | 12/1987 | LeClear | 62/150 |
| 4,876,861 | 10/1989 | Tanaka et al. | 62/279 |
| 5,074,119 | 12/1991 | Anderson | 62/150 |
| 5,226,298 | 7/1993 | Yamamoto et al. | 62/3.4 |
| 5,279,128 | 1/1994 | Tomatsu et al. | 62/3.4 |
| 5,375,421 | 12/1994 | Hsieh | 62/3.4 |
| 5,444,984 | 8/1995 | Carson | 62/3.4 |
| 5,448,891 | 9/1995 | Nakagiri et al. | 62/3.4 |
| 5,555,732 | 9/1996 | Whiticar | 62/3.4 |
| 5,884,486 | 3/1999 | Hughes et al. | 62/3.4 |
| 5,921,088 | 7/1999 | Imaizumi et al. | 62/3.4 |

OTHER PUBLICATIONS

Abstract of U.S. Patent No. 5,813,235 issued Sep. 29, 1998.

Abstract of JP Patent No. 10–141792 issued May 29, 1998.

Abstract of JP Patent No. 10–103802 issued Apr. 24, 1998.

Abstract of DE Patent No. 197 13 575 issued May, 28, 1998.

Abstract of RU Patent No. 2110737 issued May 10, 1998.

Abstract of the Proceedings of the Annual Conferences of Power & Energy Society "Influence of the Properties of Working Fluid upon the Thermoacoustic Refrigerating Capacity" 1998.

Abstract of the Proceedings of the International Sessions JSME Spring Annual Meeting "Pumping Performance of a Thermoacoustic Refrigerator" 1998.

Abstract of the Proceedings of the International Sessions JSME Spring Annual Meeting "Influence of Working Fluid upon Thermoacoustic Characteristics" 1998.

Abstract of "Development and Testing of 5kW Stirling Refrigerator for Air Conditioning", K. Shoichi et al., 1998.

Abstract of JP Patent No. 9–264624 issued Oct. 7, 1997.

Abstract of JP Patent No. 9–264623 issued Oct. 9, 1997.

Abstract of U.S. Patent No. 5673561 issued Oct. 7, 1997.

Abstract of "Develoment of a Stirling Refrigerator with a Higher Coefficient of Performance", F. Steimle, et a., Oct. 1997.

Abstract of WO Patent No. 9734357 issued Sep. 18, 1997.

Abstract of JP Patent No. 9–210489 issued Aug. 12, 1997.

Abstract of JP Patent No. 9–178281 issued Jul. 11, 1997.

Abstract of EP Patent No. 778452 issued Jun. 11, 1997.

Abstract of RU Patent No. 2080527 issued May 27, 1997.

(List continued on next page.)

*Primary Examiner*—William Doerrler
*Assistant Examiner*—Mark Shulman
*Attorney, Agent, or Firm*—Pennie & Edmonds LLP

[57] ABSTRACT

A dehumidifier which includes a thermoelectric cooler having first and second ends on opposite sides, with the first end being cooler than the second end during operation; a first plate which is thermally conductive and has first and second surfaces on opposite sides, wherein the first surface is thermally coupled to the first end of the thermoelectric cooler; a second plate spaced from and facing the second surface of the first plate to form a first air passage therebetween; and a fan positioned to cause air to flow through the first air passage, wherein the air flowing through the first air passage is dehumidified as moisture therein condenses on the second surface of the first plate. The invention also relates to a dispensing machine which includes the humidifier and a method for dehumidifying air in the dispensing machine or in other devices.

26 Claims, 4 Drawing Sheets

OTHER PUBLICATIONS

Abstract of RU Patent No. 2079800 issued May 20, 1997.
Abstract of Institution of Electrical Engineers Article "Construction of a Thermoacoustic Refrigerator", May 1997.
Abstract of JP Patent No. 9–101064 issued Apr. 15, 1997.
Abstract of WO Patent No. 9707368 issued Feb. 27, 1997.
Abstract of WO Patent No.9705433 issued Feb. 13, 1997.
Abstract of International Journal of Refrigeration Article "Design Optimization of Thermoacoustic Refrigerators" 1997.
Abstract of the Proceedings of the Annual Conference of Power & Energy Society, "Characteristics of Heat Driven Thermoacoustic Refrigerator" 1997.
Abstract of "Optimization on the Configuration of a Thermoacoustic Refrigerator", T. Hidetomo et al., 1997.
Abstract of the Proceedings of the Sympoium on Stirling Cycle, "Basic Characteristics of Thermoacoustic Oscillator", 1997.
Abstract of "Oscillation–Induced Heat–Transport (Thermoacoustic) Phenomena and its Application to Thermal Equpment",O. Mamoru, 1997.
Abstract of the Proceedings of the International Sessions JSME Spring Annual Meeting "Characteristics of Heat–Driven Thermoacoustic Cooling System" 1997.
Abstract of "Thermodynamic Performance Analysis of the Displacer Type Stirling Cycle Refrigerator", I. Hiroki et al., 1997.
Abstract of "A Stirling Refrigerator with a Nylon–Matrix Regenerator", Y. Toshimasa, 1997.
Abstract of "Performance of Stirling Cycle Refrigerator Around Air Conditioning Temperatures", S. Shinji et al., 1997.
Abstract of "A Trial Protection of the Stirling Cycle Refrigerator and an Experimental Study", T. Hitoshi et al, 1997.
Abstract of WO Patent No. 9639599 issued Dec. 12, 1996.
Abstract of CN Patent No. 1137631 issued Dec. 11, 1996.
Abstract of CN Patent No. 1137630 issued Dec. 11, 1996.
Abstract of JP Patent No. 8–320157 issued Dec. 3, 1996.
Abstract of JP Patent No. 8–313072 issued Nov. 29, 1996.
Abstract of WO Patent No. 9624808 issued Aug. 15, 1996.
Abstract of FR Patent No. 2730556 issued Aug. 14, 1996.
Abstract of IT Patent No. 1261634 issued May 23, 1996.
Abstract of EP Patent No. 695919 issued Feb. 7, 1996.
Abstract of GB Patent No. 2,291,959 issued Feb. 7, 1996.
Abstract of the Annual Report of the CTR Blanket Engineering "Basic Study on a Thermoacoustic Refrigerator" 1996.
Abstract of "Heat Transfer Phenomena of Thermoacoustic Refigerator", K. Sadayoshi et al., 1996.
Abstract of "Performance of Thermoacoustic Cooling System" S. Kazumi et al., 1996.
Abstract of "Heat Transfer Phenomena of Thermoacoustic Refrigerator", K. Sadayoshi et al., 1996.
Abstract of "Theoretical Analysis of a Thermoacoustic Refrigerator", H. Eiji, 1996.
Abstract of the Proceedings of the International Sessions JSME Spring Annual Meeting "Characteristics of Heat Driven Sound Wave Generator for Thermoacoustic Refrigerator" 1996.
Abstract of "Performance Analysis of a 100W Class Stirling Refrigerator", M. Naoki et al., 1996.
Abstract of "The Optimization of a Stirling Refrigerator based on Shmitt Analysis", H. Tatsuya et al., 1996.
Abstract of JP Patent No. 7–324652 issued Dec. 12, 1995.
Abstract of DE Patent No. 4345137 issued Jun. 29, 1995.
Abstract of "Development of a Small Size Refrigerating Stirling Machine for Moderated Thermal Level", P. Nika et al., Jun. 1995.
Abstract of KR Patent No. 9500384 issued Jan. 16, 1995.
Abstract of "Study on Cooling System for Automobile Using Thermoacoustic Phenomena", M. Katsuya et al., 1995.
Abstract of "Refrigeration Performance of a Thermoacoustic Refrigerator", H. Toshitsugu et al., 1995.
Abstract of "A Trial Production of the Stirling Refrigerator and Evaluation of its Characteristics", I. Takao et al., 1995.
Abstract of U.S. Patent No. 5,363746 issued Nov. 15, 1994.
Abstract of RU Patent No. 2018063 issued Aug. 15, 1994.
Abstract of DE Patent No. 4336712 issued Apr. 28, 1994.
Abstract of U.S. Patent No. 5,303,555 issued Apr. 19, 1994.
Abstract of KR Patent No. 9402221 issued Mar. 19, 1994.
Abstract of RU Patent No. 2006759 issued Jan. 30, 1994.
Abstract of GB Patent No. 2,268,257 issued Jan. 5, 1994.
Abstract of "Cooling by Sound Wave (An Application of Thermoacoutis Effect(", I. Tatsuo, 1994.
Abstract of CN Patent No. 1079044 issued Dec. 1, 1993.
Abstract of U.S. Patent No. 5,245,840 issued Sep. 21, 1993.
Abstract of U.S. Patent No. 5,186,206 issued Feb. 16, 1993.
Abstract of KR Patent No. 9300943 issued Feb. 11, 1993.
Abstract of KR Patent No. 9300942 issued Feb. 11, 1993.
Abstract of KR Patent No. 9300941 issued Feb. 11, 1993.
Abstract of "Temperature Distribution in a Thermoacoustic Tube Refrigerator", H. Toshitsugu et al., 1993.
Abstract of "Fluorocarbon–Free Refrigeration and Air–Conditioning Systems",T. Suganami et al., 1993.
Abstract of "Feasibility Study of a Freon–Free Automotive Air Conditioner with Stirling Refrigeration Cycle", H. Kenji et al., 1993.
Abstract of U.S. Patent No. 5,094,083 issued Mar. 10, 1992.
Abstract of JP Patent No. 3–215157 issued Sep. 20, 1991.
Abstract of GB Patent No. 2,237,866 issued May 15, 1991.
Abstract of U.S. Patent No. 5,010,736 issued Apr. 30, 1991.
Abstract of "Thermoacoustic Theory of Regenerator in Refrigerator", T. Akira, 1991.
Abstract of SU Patent No. 1566180 issued May 23, 1990.
Abstract of U.S. Patent No. 4,735,470 issued Apr. 5, 1988.
Abstract of U.S. Patent No. 4,711,650 issued Dec. 8, 1987.
Abstract of DD Patent No. 249749 issued Sep. 16, 1987.
Abstract of SU Patent No. 1283499 issued Jan. 15, 1987.
Abstract of U.S. Patent No. 4,522,032 issued Jun. 11, 1985.
Abstract of EP Patent No. 130143 issued Jan. 2, 1985.
Abstract of U.S. Patent No. 4,397,154 issued Aug. 9, 1983.
Abstract of SU Patent No. 935684 issued Jun. 14, 1982.
Abstract of SU Patent No. 641243 issued Jan. 5, 1979.
Abstract of SU Patent No. 612130 issued May 26, 1978.
Abstract of "Thermodynamic Irreversibility of Cooling with a Refrigerator Functioning in a Reverse Stirling Cycle", V. Kovachev, 1975.
Abstract of GB Patent No. 1,199,211 (no issue date).
Abstract of U.S. Patent No. 3,654,768 (no issue date).
Abstract of SU Patent No. 283246 (no issue date).
Abstract of SU 279645 (no issue date).

BEVERAGE DISPENSER WITH A DEHUMIDIFIER UTILIZING A THERMOELECTRIC COOLER

FIELD OF THE INVENTION

The present invention generally relates to beverage dispensers that include dehumidifiers to lower humidity therein. More specifically, the dehumidifiers utilize thermoelectric coolers to condense and remove moisture from inside of the dispensers.

BACKGROUND OF THE INVENTION

Various automated beverage dispensers for making hot or cold beverage products are known in the art. In a conventional beverage dispenser, a metered amount of water-soluble beverage powder, stored in a powder storage chamber, and a metered amount of hot or cold water, supplied from a water source, are conveyed into a mixing chamber to produce a beverage product, which is dispensed into a cup. In more sophisticated beverage dispensers, a number of different types of beverage making powders are stored in a storage chamber to produce different types of beverage products, e.g., coffee, tea, hot chocolate or exotic tropical drinks, at a user's choice. Because these beverage dispensers conveniently produce different types of beverage products with consistently high quality, these types of beverage dispensers are finding increasing acceptance with households, restaurants and the vending machinery industry.

In the above described beverage dispensers, the common problem is caking or clumping, caused by humidity, of the beverage making powders. When the powders are caked or clumped, dispensing the powders in accurate amounts becomes difficult, and, in some extreme cases, powders may become unsuitable for human consumption. Therefore, dehumidifiers that can efficiently control humidity inside the powder storage chambers are highly desired.

SUMMARY OF THE INVENTION

The present invention relates to a dehumidifier comprising a thermoelectric cooler having first and second ends on opposite sides, with the first end being cooler than the second end during operation; a first plate which is thermally conductive and has first and second surfaces on opposite sides, wherein the first surface is thermally coupled to the first end of the thermoelectric cooler; a second plate spaced from and facing the second surface of the first plate to form a first air passage therebetween; and a air circulating means for causing air to flow through the first air passage, wherein the air flowing through the first air passage is dehumidified as moisture therein condenses on the second surface of the first plate.

Advantageously, a thermally conductive buffer block is disposed between the first end of the thermoelectric cooler and the first plate. This block preferably is substantially made of copper and imparts a spacing between the first end of the thermoelectric cooler and the first plate.

If desired, the dehumidifier may include a housing having first and second surfaces located on opposite sides and defining a first orifice, wherein the orifice is configured to receive and hold the thermoelectric cooler; and a pair of side panels mounted on the first surface of the housing and configured to rigidly hold the second plate thereto. The first plate is preferably mounted on the first surface of the housing between the pair of side plates, thereby forming an inlet and an outlet at a top side and a bottom side of the first air passage, respectively. In this arrangement, the inlet of the first air passage is disposed above the outlet of the first air passage to cause any moisture condensed on the second surface of the first plate to flow to the outlet of the first air passage. Also, the air circulating means is a fan that is positioned to draw air from the outlet of the first passage during operation of the fan.

In another arrangement, a back panel is disposed apart from the second plate, wherein the fan is mounted on the back panel; a top panel configured to connect a top side of the second plate to a top side of the back panel; and a bottom panel configured to connect a bottom of the back panel to the housing below the first plate; and the two side panels further configured to be connected to the back panel, the top panel, and the bottom panel, to thereby form an outer air passage and to thereby force the air to flow toward the fan in the first and second air passages when the fan is in operation. If desired, a third plate may be disposed between the back panel and the second plate to create a second air passage between the second plate and the third plate. Also, the housing can further define a second orifice located between the bottom of the first plate and above where the bottom plate is connected to the housing, such that the second orifice is filled up with a material that allows water to sip therethrough while preventing air from flowing therethrough. This material may be a piece of wicking fabric.

In another arrangement, a movable door is included, and the back panel further defines an additional air intake opening configured to mount the movable door. Thus, the movable door may be moved to open or close the additional air intake opening. Advantageously, the housing includes a control device including at least one of a fan control device configured to control the speed of the fan, a door control device configured to move the movable door, and a TEC power supply control device configured to control power supply to the thermoelectric cooler; and a controller configured to send controlling signals to the control device for controlling the operation of the dehumidifier, to thereby optimally control the operation of the dehumidifier.

Another embodiment of the invention relates to a beverage dispenser that includes the previously described dehumidifier.

Yet another embodiment of the invention relates to a method of dehumidifying a chamber that stores beverage making powder. This method comprising the steps of drawing air from inside of the chamber; flowing the drawn air on a cold surface to cause moisture in the air to condense thereon, thereby dehumidifying the air; returning the dehumidified air to the chamber; collecting the moisture formed on the cold surface; passing the collected moisture to outside of the chamber through a conduit; and preventing air from the outside to enter the chamber through the conduit, to thereby ensure low humidity within the chamber.

This method also can include the steps of controlling an air flow speed on the cold surface to thereby maintain the humidity inside the chamber within a predetermined range. Thus, the predetermined humidity range can be maintained between about 28% and 60%.

If desired, the temperature and humidity of the air inside the chamber can be measured; and the airflow speed automatically controlled according to the measured temperature and humidity for maintaining the air inside the chamber at predetermined ranges of temperature and humidity. It is also possible to include the step of cooling a heat sink of the cold surface for maintaining the cold surface at a lower temperature than that of the air inside the chamber. Further, the temperature inside the chamber can also be controlled.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENTS

Figure 1:
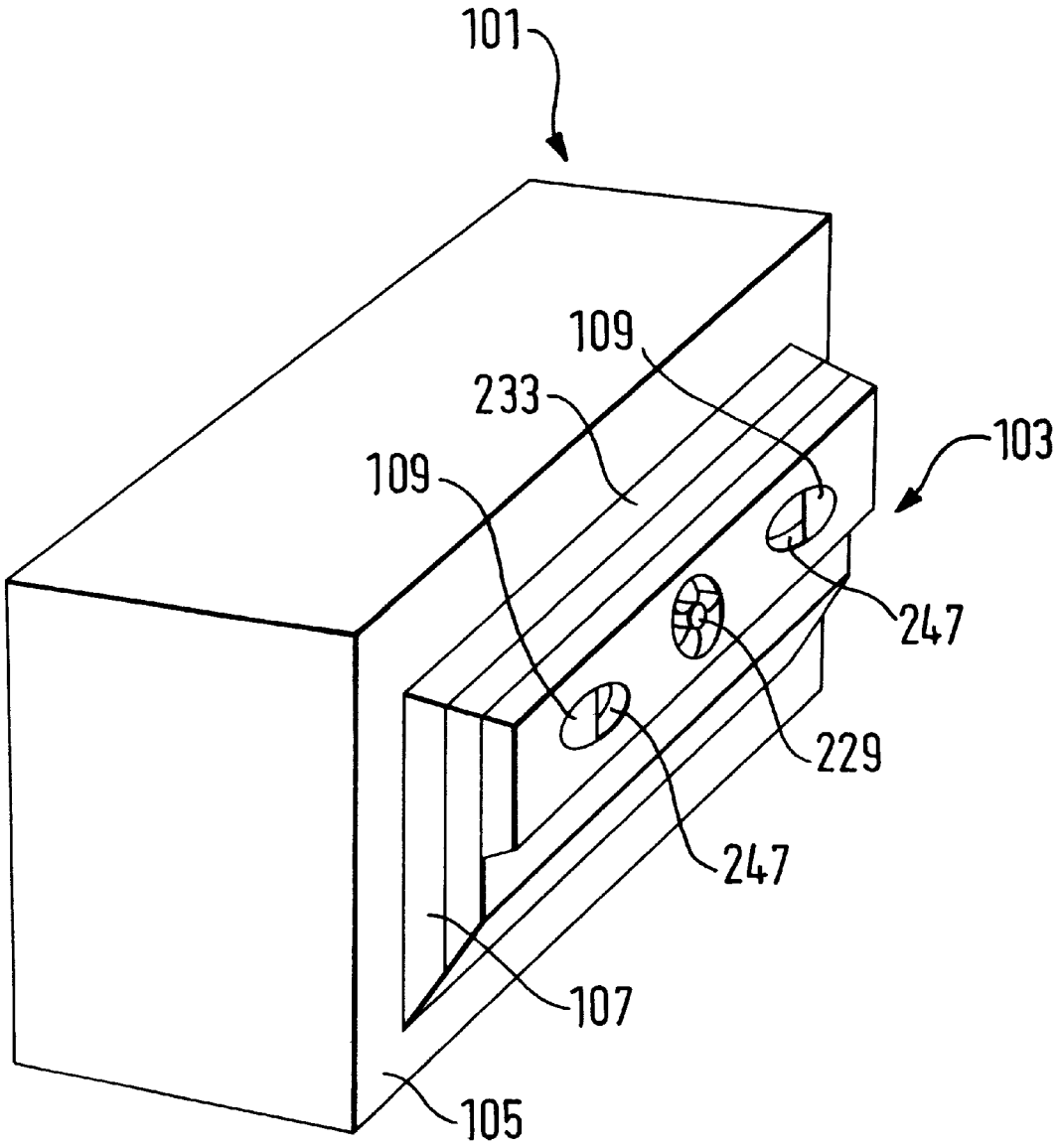
FIG. 1 is a perspective view of a dehumidifier of the present invention installed on a wall of a beverage dispenser.

Referring to FIG. 1, there is illustrated a portion of a beverage dispenser 101 with a dehumidifier 103 of the present invention installed thereon. More specifically, a wall 105, into which the dehumidifier 103 is installed, forms a part of the beverage making powder chamber so that the dehumidifier 103 can remove moisture from the air inside of the chamber.

Figure 2:
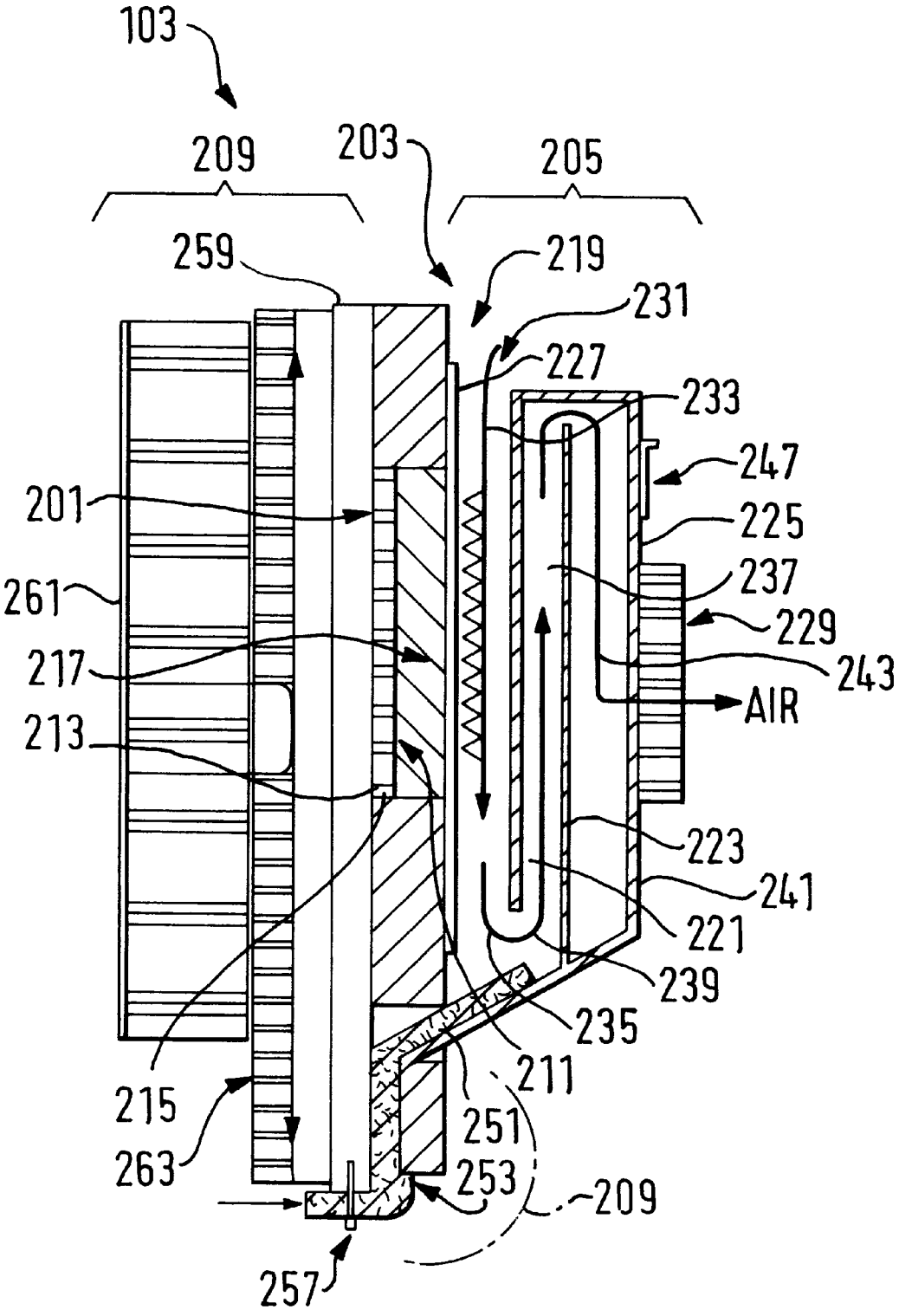
FIG. 2 is a cross-sectional view of the dehumidifier of the present invention.

Referring to FIG. 2, the dehumidifier 103 of the present invention includes a thermoelectric cooler (TEC) 201, a housing 203 into which the TEC 201 is placed, a cold side structure 205, a heat sink side structure 207 and a moisture disposal conduit 209.

The TEC 201 has a cold side 211 and a heat sink side 213. The TEC is formed as a thermopile by connecting in series a plurality of thermocouples 215 in a known manner: each thermocouple consisting of a p-type semiconductor and a n-type semiconductor electrically connected between two poles of a direct-current power supply to produce a cool junction and a warm junction on the cold side 211 and the heat sink side 213 of the TEC 201, respectively. The electrical power, typically 12V, is supplied to the TEC 201 from a power source by electrical wiring. Thus, in operation the cold side 211 is maintained to be colder than the heat sink side 213. The dimension of a typical TEC with 30 watts heat load capacity is approximately 40×40×2 mm. The TEC 201 is also known as a thermoelectric module, a Peltier cooler or a thermoelectric heating/cooling device in the art.

The housing 203, preferably made of a rigid material with no substantial thermal conductivity, has an opening within which to receive the TEC 201. The housing 203 is mounted into the wall 105 of the beverage dispenser 101, as described above, and divides the dehumidifier 103 into the cold side structure 205 and the heat sink side structure 207. Once the housing 203 is mounted into the wall 105, the cold side structure 205 is disposed inside of the chamber and the heat sink side structure 207 is disposed outside of the chamber. Although the housing 203 is made of the thermally non-conductive material, there is some inevitable thermal conductivity between the heat sink side structure 207 and the cold side structure 205 of the dehumidifier 103 when they are located too close together. In order to minimize the unwanted thermal conductivity, the thickness of housing 203 is preferably between 5 mm and 20 mm, which is thicker than that of the TEC 201. The difference in the thickness between the TEC 201 and the housing 203 is compensated by inserting a buffer block 217 made of thermally conductive and rigid material. Preferably, the buffer block 217 is made of copper, but other thermally conductive material such as aluminum provides a good alternative to copper. The buffer block 217 is preferably disposed between the TEC 201 and the cold side structure 205 in order to transfer the cold temperature generated from the TEC 201 to the cold side structure 205. As alternatives, it should be noted that the buffer block 217 can be disposed between the heat sink side structure 207 and the TEC 201 or that two buffer blocks can be provided one on each side of the TEC. In the embodiments described above, a thermally conductive insert, such as thermally conductive grease, is provided between the buffer block(s) and the TEC 201, between the buffer block and the cold side structure 205, and between the buffer block and the heat sink side structure 207 in order to ensure thermal conductivity among these components. Further, applying undue stress, in an attempt to thermally connect the components, to the TEC 201 is avoided by providing the thermally conductive grease between the components.

The cold side structure 205 includes an active cold plate 219, a secondary plate 221, an outer plate 223, an outer shell 225 and a fan 229 installed on the outer shell 225.

The active cold plate 219 is made of thermally conductive and anti-corrosive material, preferably, aluminum. The active cold plate 219 has a rectangular shape, e.g., 50×30 mm to 100×80 mm. The active cold plate 219 has two surfaces: a TEC-coupled surface, facing the cold side 211 of the TEC 201, and a condensation surface 227. The TEC-coupled surface of the active cold plate 219 is either directly attached to the TEC 201, when no buffer block is inserted therebetween, or thermally coupled to the TEC 201 via the buffer block 217. The condensation surface 227 is preferably flat and left untreated. In an alternative embodiment, the condensation surface 227 has a plurality of fins and/or grooves formed thereon in order to increase the surface area. In this embodiment, the fins and/or grooves are vertically formed; however, they can be in any other shapes such as a winding shape or a zigzagging shape. In addition, thermally conductive and hydrophobic plastics, e.g., nylon or metalized plastics, can be deposited upon the condensation surface 227 to further prevent corrosion thereon.

The secondary plate 221 is made from substantially the same material and shaped as that of the active cold plate 219. It should be noted, however, that the secondary plates can be made from any other material that is rigid, thermally conductive and anti-corrosive material such as copper. Preferably, the secondary plate 221 has flat surfaces. In alternative embodiments, the surfaces of the secondary plate 221 may have fins and/or grooves, similar to the alternative embodiments of the active cold plate 219. In addition, thermally conductive hydrophobic plastics can be applied to the surfaces of the secondary plate 221 to further protect the surfaces from corrosion. The secondary plate 221 is disposed apart from and substantially parallel to the active cold plate 219. Two side panels 107 that are parts of the outer shell 225 are provided to rigidly hold the secondary plate 221 in relation to the active cold plate 219. The side panels 107 are also rigidly attached to the surface of the housing 302 placing the active cold plate 219 between the side panels 107.

A first air passage 231 is formed by the active cold plate 219 on one side, the secondary plate 221 on the opposite side and the two side panels 107 of the outer shell 225. The first air passage 231 has two openings: an inlet 233 from which to draw air from the chamber and an outlet 235 to which air flows out from the first air passage 231. The gap between the active cold plate 219 and the secondary plate 221 is 5–20 mm. With this configuration, the size of the inlet 233 of the first air passage 231 is between 5×50 mm and 20×100 mm.

The outer plate 223, made of rigid and thermally non-conductive material such as Teflon, is disposed apart from and substantially parallel to the secondary plate 221. This arrangement, along with extensions of the two side panels 107 of the outer shell 225, forms a second air passage 237. Preferably, the outlet 235 of the first air passage 231 connects to an inlet 239 of the second air passage 237, to thereby allow the air from the first air passage 231 to flow to the inlet 239 of the second air passage 237. It should be noted that additional secondary plates can be provided between the active cold plate 219 and the outer plate 223 in alternative embodiments. In these alternative embodiments, additional air passages are formed by the additional secondary plates, and the additional air passages are connected similar to the connection between the first and the second air passages 231, 237.

The outer shell 225 is made of rigid and thermally non-conductive material, e.g., Teflon, and shaped to rigidly hold the secondary cold plate 221 and the outer plate 223 with the two side panels 107 as described above. The outer shell 225 also forms an outer wall 241, which is shaped as a panel and disposed apart from and substantially parallel to the outer plate 223, thereby forming an outer air passage 243. It should be noted that the components described above that form the cold side structure are made of materials safe for food processing.

The fan 229 is mounted on the outer wall 241. When the fan 229 is in operation, it draws air from the outer air passage 243, which in turn draws air from the second air passage 237, which in turn draws air from the first air passage 231 and which in turn draws air from the chamber through the inlet 233 of the first air passage 231. In other words, the fan 229 is provided to forcibly flow the air through the air passages 231, 237, 243. It should be noted that fan 229 can be a blower or any other means to circulate the air through the air passages.

More specifically, in operation of the cold side structure 205, the air from the inside of the chamber, presumably humid, is drawn into the first air passage 231 via its inlet 233. The humid air flows down through the first air passage 231 to its outlet 235. While the humid air is flowing from the inlet 233 to the outlet 235 of the first air passage 231, it comes in contact with the condensation surface 227 of the active cold plate 219. Because the air from the chamber is warmer than the condensation surface 227, the moisture in the air drawn in from the chamber is condensed thereon, thereby removing the moisture from the air and making it less humid. Furthermore, because the condensation surface 227 cools the air that comes in contact with it, the air exiting at the outlet 235 of the first air passage 231 is colder than the air entering the inlet 233 of the first air passage 231. This also causes the upper portion of the secondary plate 221 near the inlet 233 of the first air passage 231 to be warmer than the lower portion of the secondary plate 221 near the outlet 235 of the first air passage 231. Therefore, as the cold air flows from the inlet 239 of the second air passage 237 to its outlet, some heat exchange takes place between the cold air in the second air passage 237 and the upper portion of the secondary cold plate 221. This heat exchange serves to cool the upper portion of the secondary plate 221, warms up the air temperature as it flows through the second air passage 237. This results in an efficient dehumidifier configuration because the cooled upper portion of the secondary plate 221 assists in cooling down the air temperature near the inlet 233 of the first air passage 231.

TABLE 1

| | | | |
|---|---|---|---|
| Environment | 23° C./45% | 33° C./85% | 33° C./80% |
| Chamber initial | 23° C./87% | 33° C./85% | 33° C./80% |
| Time Down to 60% | 12 min. | 10 min. | 9 min. |
| Time Down to 50% | 22 min. | 20 min. | 19 min. |
| Time Down to 40% | 46 min. | 60 min. | 65 min. |
| Final RH | 28% | 36% | 38% |

TABLE 2

| | | | | |
|---|---|---|---|---|
| Environment | 32° C./88% | 34° C./88% | 33° C./85% | 33° C./81% |
| Chamber initial | 32° C./89% | 34° C./81% 1" opening | 33° C./77% 3" opening | 33° C./81% 4.5" opening |
| Time Down to 60% | 40 min. | 35 min. | 20 min. | 40 min. |
| Time Down to 50% | 70 min. | 65 min. | 80 min. | |
| Final RH | 41% | 45% | 48% | 58% |

Table 1 and 2 illustrate performance characteristics of preferred embodiments where a 150-liter chamber and a 280-liter chamber, respectively, are dehumidified using the dehumidifier of the present invention. Each table shows the initial temperature and relative humidity (RH) of the environment and respective chambers. The final relative humidities (RHs) and the lengths of time the dehumidifier operated to achieve the final RHs are also shown. With respect to Table 2, an opening is bored into the 280-liter chamber in order to determine the operational capability of the dehumidifier of the present invention when the chamber is not completely sealed air tight. The diameters of the openings are noted in the second row of Table 2.

Notwithstanding the efficient dehumidifier configurations described above, in an alternative embodiment, the outer plate 223 is removed. In this embodiment, the cold air exiting from the outlet 235 of the first air passage 231 is drawn out to the chamber via the fan 229, thereby lowering the temperature as well as the humidity inside the chamber. Moreover, a rate of dehumidification, defined herein as the amount of humidity removed from the air by the dehumidifier within a unit time period, can be further adjusted. In particular, the lengths of the air passages, the speed of the air flowing through the air passages, the temperature difference between the active cold plate 219 and the air at the inlet 233 of the first air passage 231 and other similar variables all contribute in controlling the rate of dehumidification. The lengths of the air passages and the speed of the air flowing through the air passages are related to a dwell time of the air on the condensation surface. In principle, as the dwell time increases, more condensation takes place on the condensation surface 227. Therefore, in order to increase or decrease the rate of dehumidification, various structural components can be modified and/or some aspects of the operations of the dehumidifier can be controlled.

With respect to modifying the structural components, in an alternative embodiment a more powerful TEC can be provided to increase the temperature difference between the active cold plate 219 and the air inside the chamber causing more moisture to condense on the condensation surface 227, to thereby lower the humidity at a faster rate. In another alternative embodiment, the sizes of the TEC, the active cold plate 219 and the secondary plate 241 are increased to provide a larger area of the condensation surface, to thereby increase the dwell time. In yet another alternative embodiment, the inlet 233 of the first air passage 231 is configured to be wider than the outlet 235 by slanting the secondary plate 221 so that the upper portion of the secondary plate 221 is further away from the active cold plate 219 than that of the lower portion of the secondary plate 221. As more air can be drawn through the inlet 233 of the first air passage 231 than flowing out of its outlet 235, the air flowing through the first air passage 231 would be slower, thereby increasing the dwell time. In another embodiment, a pair of intake openings 247 is provided on the outer shell 225 near the fan 229. These openings reduce the air drawing power of the fan 229 through the air passages, thereby, again, lengthening the dwelling time.

With respect to operationally controlling the rate of the dehumidification, in one embodiment, the air flow speed can be controlled by changing various aspects of the operation of the dehumidifier such as changing the fan speed or controlling the electrical power applied to the TEC. Furthermore, in the alternative embodiment described above that has a pair of intake openings 247, when a movable door 109 is provided for each of the pair of intake openings 247, the doors can be moved to adjust to increase or decrease the size of openings. These various aspects of the operation can be manipulated by an automated control system.

Figure 3:
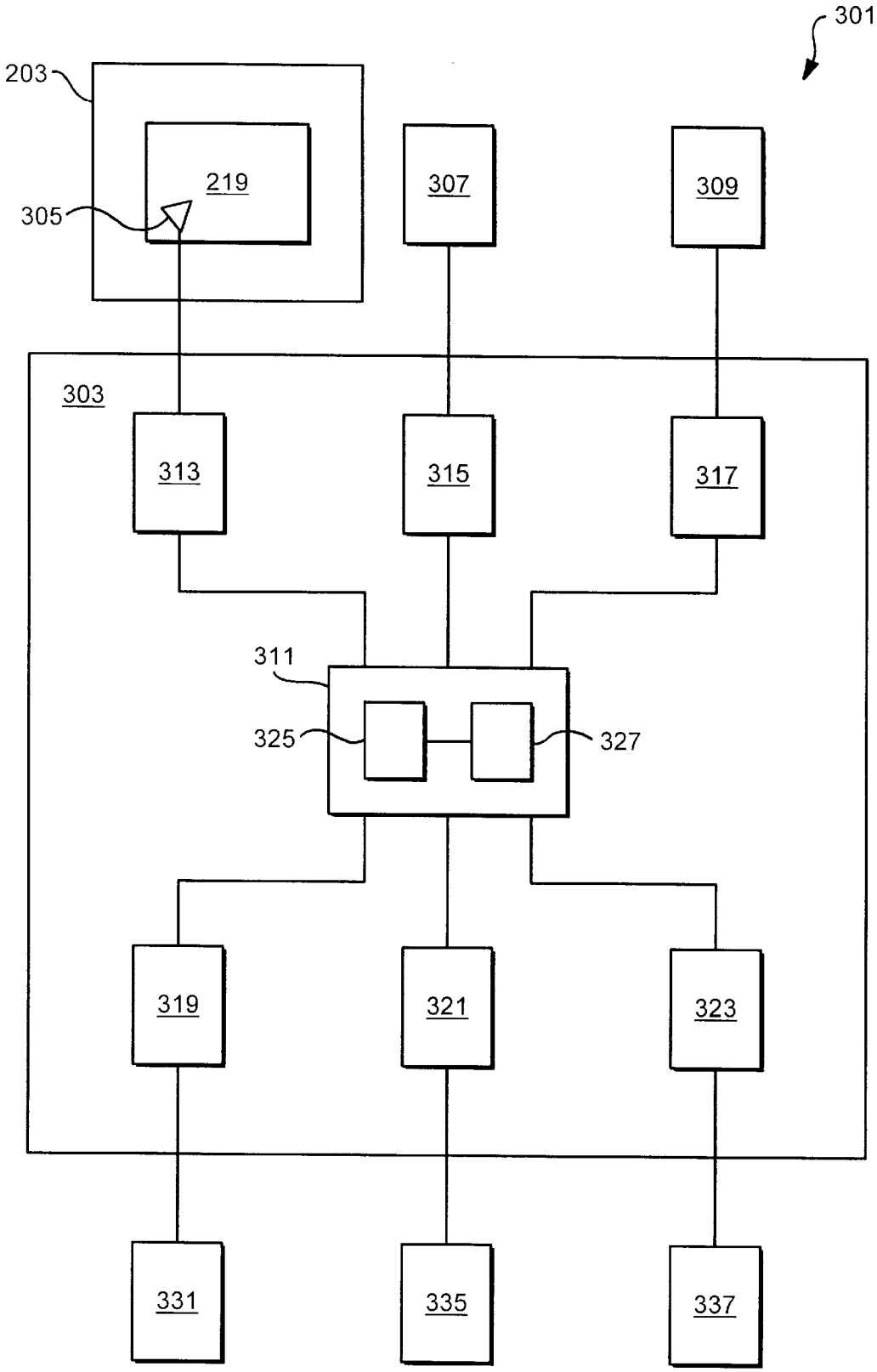
FIG. 3 is a block schematic diagram of a control system of the dehumidifier of the present invention.

Referring to FIG. 3, there is shown a schematic block diagram of the automated control system 301 for the dehumidifier of the present invention. The control system 301 includes a plurality of sensors 305, 307, 309 to determine the conditions inside the chamber and a control circuit 303 to receive corresponding measurements from the sensors 305, 307, 309. The control system 301 also includes control devices 331, 335, 337 to control the various aspects of the operation.

The plurality of sensors includes a first temperature sensor 305 configured to measure the temperature of the active cold plate 219, a second temperature sensor 307 configured to measure the temperature of the air inside the chamber, and a humidity sensor 309 to measure the humidity of inside the chamber. The measurements made by the sensors are sent to the control circuit 303. The control devices include a TEC power control device 331, configured to shut off or turn on the power supply to the TEC 201, a fan speed control device 335, configured to control the speed of the fan 229, and a door control device 337, configured to move the movable doors 109.

The control circuit 303 includes a processor 311, a set of input interface devices 313, 315, 317 to receive the measurements from the sensors 305, 307, 309, respectively, and a set of output interface devices 319, 321, 323 to send control signals to the control devices 331, 335, 337, respectively. The processor 311 preferably includes a microprocessor 325 and a memory device 327 coupled thereto.

The input interface devices 313, 315, 317 between the control circuit 303 and the sensors 305, 307, 309 allow the control circuit 303 to receive the measured data from the sensors. Base on the received measured data, the processor 311 makes decisions as to how to control the control devices 331, 335, 337. The output interface devices 319, 321, 323 allow the control circuit 311 to send signals to the control devices 331, 335, 337 based on the decisions made by the processor 311.

For example, if the temperature measured by the temperature sensor 305 coupled to the active cold plate 219 falls below a certain temperature, e.g., −4° C., then controller 303 would send a signal to the TEC power control device 331 to turn off the power supply to the TEC 201. In other words, when the moisture condensed on the condensation surface 227 freezes because the condensation surface 227 temperature is below the freezing point for water, then the power to the TEC 201 is shut off in order to raise the temperature of the condensation surface 227, to thereby melt the ice formed on the condensation surface 227. When the temperature rises above a certain temperature, e.g., the freezing point, the power would be turned on again.

In another example, if the humidity inside the chamber is to be maintained at a certain range, e.g., see Tables 1 and 2 above, then depending upon the humidity measurements from the humidity sensor 309, the control circuit 303 may open or close the movable door 109 and/or adjust the speed of the fan 229.

The above described example schemes and other similar schemes are stored in the memory device 327 in the form of the processor 325 executable instructions. The stored executable instructions, when loaded and executed by the processor 325, monitor the variations and interrelationship among the measurements received from the sensors 305, 307, 309 and predetermined conditions, e.g., optimal range of humidity and/or temperature inside the chamber, and the status of the control devices 331, 335, 337. Based on the monitoring mentioned above, the stored executable instructions cause the control circuit 331 to issue appropriate control signals to the control devices 331, 335, 337.

It should also be noted that, for the proper control of the dehumidifier, none, only one or any combination of the sensors 305, 307, 309 and the control devices 331, 335, 337 is required. As described above, in some instances, the length, the shape and the number of air passages are properly designed so that no control system 301 is required in maintaining the desired humidity level in the chamber. In other instances, only the temperature sensor 305 on the active cold plate 219 and the TEC power control device 331 are all that is required. In yet other instances, all of the sensors 305, 307, 309 and control devices 331, 335, 337 may be required to properly maintain the humidity and temperature inside the chamber.

Referring back to FIG. 2, the moisture disposal conduit 209 preferably includes a side orifice 251 formed in the housing 203, having a length that is coextensive as that of the active cold plate 219 and open to the heat sink side structure 207. The side orifice 251 is then plugged with a piece of wicking fabric 253 that starts near the inlet 239 of the second air passage 237 to the heat sink side structure 207. A fastener 257, e.g., a nail, screw or wire, is provided to removably fasten the wicking fabric 253 to a base plate 259 of the heat sink side structure 207. Further, the bottom of the outer shell 225 is slanted so that any moisture dripping down on the wicking fabric 253 would be urged to slip down and flow to the heat sink side structure 207. In other words, in operation of the dehumidifier 103, moisture drips down from the condensation surface 227 of the active cold plate 219 and from the two surfaces of the secondary plate 221. The moisture collected, water at this point, is passed through the wicking fabric 253 to the heat sink side structure 207 and evaporated. Any excess water not evaporated at the heat sink side structure 207 is dripped down and collected into a water collector (not shown).

The wicking fabric 253 allows the water to pass but prevents air from passing therethrough. This configuration is desired to achieve a thermal separation between the cold side, located in the inside the chamber, and the heat sink side, located in the outside of the chamber. If the conduit 209 allows the air to pass therethrough freely, the humidity and temperature control inside the chamber becomes more difficult and inefficient due to the outside air coming in and the inside air going out though the conduit 209. The wicking fabric is a commercially available humidifier filter material. Exemplary wicking fabric is available from RPS Products located in Hampshire, Ill. or The Barker Company located in Seattle, Wash. It should be noted that other similar material possessing the similar characteristics with that of the wicking fabric described above can be used. Another desirable characteristic of the wicking fabric is that it can be replaced periodically.

Figure 4:
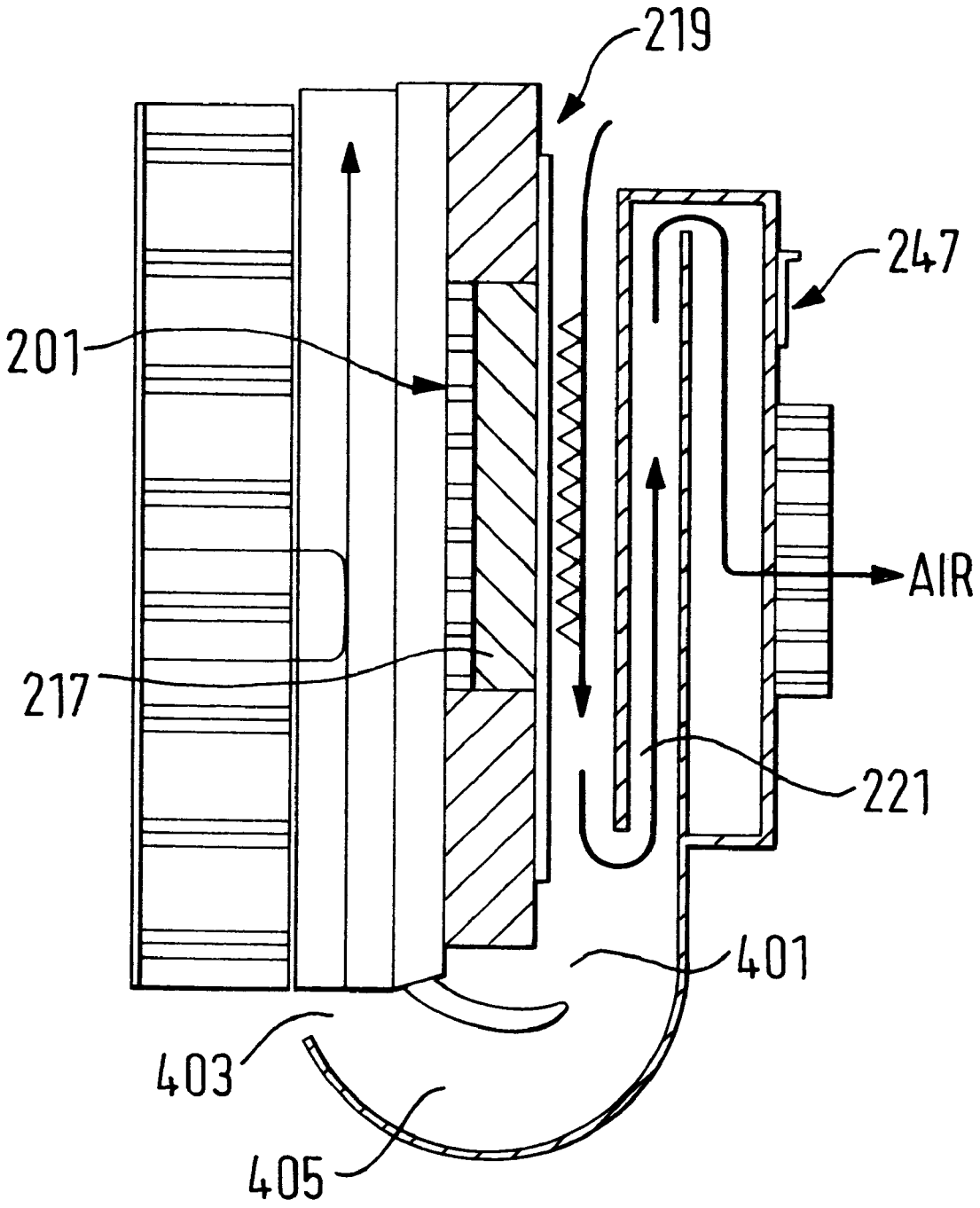
FIG. 4 is a cross-sectional view of an alternative embodiment of the dehumidifier of the present invention.

FIG. 4 illustrates an alternative embodiment of the moisture disposal conduit that includes a cold side opening 401 and a heat sink side opening 403, and a middle portion 405. The cold side opening 401 is configured to collect moisture dripping down from the condensation surface 227 of the active cold plate 219 and from the two surfaces of the secondary plate 221. The collected water is passed through the middle portion 405 of the conduit to the heat sink side opening 403. Preferably, the middle portion 405 is configured to allow the water to pass but prevent air from passing therethrough. This is achieved by inserting the wicking fabric in the middle portion 405 of the conduit.

Referring back to FIG. 2, the heat sink side structure 207 includes the base plate 259 and a large fan 261 mounted thereto. The base plate 259 is thermally connected to the heat sink side of the TEC 201 either directly or via a buffer block. The base plate 259 is preferably made of same material as that of the active cold plate 219, but it can be made of any other material that is rigid, thermally conductive and anti-corrosive. The base plate 259 also includes a plurality of fins 263 that are made of the substantially same material as that of the base plate and formed thereon. It should be noted that the large fan 261 can be a blower or any other means to blow air onto the base plate 259.

The fan 261 blows air onto the fins 263 and the base plate 259 to cause efficient dissipation of the heat generated at the heat sink side of the TEC 201. It should be noted that there is a direct relationship between the amount of the heat dissipated at the heat sink side and the lowering of the temperature on the cold side of the TEC 201. It should also be noted that the fins 263 are formed vertically so that the air blown in by the fan 261 is blown to the wicking fabric 253 to increase the evaporation rate of the water therefrom. It should be noted that in alternative embodiments, the fins can be formed in any direction as long as the heat can be efficiently dissipated from the heat sink side of the TEC 201.

While various descriptions of the present invention are described above, it should be understood that the various features can be used singly or in any combination thereof. Therefore, this invention is not to be limited to only the specifically preferred embodiments depicted herein. Further, it should be understood that variations and modifications within the spirit and scope of the invention may occur to those skilled in the art to which the invention pertains. For instance, the dehumidifier of the present invention can be scaled up, made much larger than the preferred embodiment, to be a dehumidifier for large grain storage rooms in tropical areas. In another instance, the dehumidifier of the present invention can be used in chambers that store food stuff such as liquid cheese and sauces.

Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A dehumidifier comprising:

a thermoelectric cooler having first and second ends on opposite sides, with the first end being cooler than the second end during operation;

a first plate which is thermally conductive and has first and second surfaces on opposite sides, wherein the first surface is thermally coupled to the first end of the thermoelectric cooler;

a second plate spaced from and facing the second surface of the first plate to form a first air passage therebetween; and an air circulating means for causing air to flow through the first air passage, wherein the air flowing through the first air passage is dehumidified as moisture therein condenses on the second surface of the first plate.

2. The dehumidifier of claim 1 further comprising a thermally conductive buffer block disposed between the first end of the thermoelectric cooler and the first plate.

3. The dehumidifier of claim 2 wherein the buffer block is substantially made of copper and imparts a spacing between the first end of the thermoelectric cooler and the first plate.

4. The dehumidifier of claim 1 further comprising:

a housing having first and second surfaces located on opposite sides and defining a first orifice, wherein the orifice is configured to receive and hold the thermoelectric cooler; and a pair of side panels mounted on the first surface of the housing and configured to rigidly hold the second plate thereto, wherein the first plate is mounted on the first surface of the housing between the pair of side plates, thereby forming an inlet and an outlet at a top side and a bottom side of the first air passage, respectively, wherein the inlet of the first air passage is disposed above the outlet of the first air passage causing the moisture condensed on the second surface of the first plate to flow to the outlet of the first air passage, and wherein the air circulating means is a fan that is further positioned to draw air from the outlet of the first passage during operation of the fan.

5. The dehumidifier of claim 4 further comprising:

a back panel disposed apart from the second plate, wherein the fan is mounted on the back panel;

a top panel configured to connect a top side of the second plate to a top side of the back panel; and a bottom panel configured to connect a bottom of the back panel to the housing below the first plate; and the two side panels further configured to be connected to the back panel, the top panel, and the bottom panel, to thereby form an outer air passage and to thereby force the air to flow toward the fan in the first and second air passages when the fan is in operation.

6. A dehumidifier comprising:

a thermoelectric cooler having first and second ends on opposite sides, with the first end being cooler than the second end during operation;

a first plate which is thermally conductive and has first and second surfaces on opposite sides, wherein the first surface is thermally coupled to the first end of the thermoelectric cooler;

a second plate spaced from and facing the second surface of the first plate to form a first air passage therebetween;

an air circulating means for causing air to flow through the first air passage, wherein the air flowing through the first air passage is dehumidified as moisture therein condenses on the second surface of the first plate;

a housing having first and second surfaces located on opposite sides and defining a first orifice, wherein the orifice is configured to receive and hold the thermoelectric cooler;

a pair of side panels mounted on the first surface of the housing and configured to rigidly hold the second plate thereto, wherein the first plate is mounted on the first surface of the housing between the pair of side plates, thereby forming an inlet and an outlet at a top side and a bottom side of the first air passage, respectively, wherein the inlet of the first air passage is disposed above the outlet of the first air passage causing the moisture condensed on the second surface of the first plate to flow to the outlet of the first air passage, and wherein the air circulating means is a fan that is further positioned to draw air from the outlet of the first passage during operation of the fan;

a back panel disposed apart from the second plate, wherein the fan is mounted on the back panel;

a top panel configured to connect a top side of the second plate to a top side of the back panel;

a bottom panel configured to connect a bottom of the back panel to the housing below the first plate;

the two side panels further configured to be connected to the back panel, the top panel, and the bottom panel, to thereby form an outer air passage and to thereby force the air to flow toward the fan in the first and second air passages when the fan is in operation; and a third plate disposed between the back panel and the second plate to create a second air passage between the second plate and the third plate.

7. The dehumidifier of claim 6 wherein the housing further defines a second orifice located between the bottom of the first plate and above where the bottom plate is connected to the housing; and wherein the second orifice is filled up with a material that allows water to sip therethrough while preventing air from flow therethrough.

8. The dehumidifier of claim 7 wherein the material is a piece of wicking fabric.

9. The dehumidifier of claim 5 further comprising a movable door, wherein the back panel further defines an additional air intake opening configured to mount the movable door, wherein the movable door is moved to open or close the additional air intake opening.

10. A dehumidifier comprising:

a thermoelectric cooler having first and second ends on opposite sides, with the first end being cooler than the second end during operation;

a first plate which is thermally conductive and has first and second surfaces on opposite sides, wherein the first surface is thermally coupled to the first end of the thermoelectric cooler;

a second plate spaced from and facing the second surface of the first plate to form a first air passage therebetween;

an air circulating means for causing air to flow through the first air passage, wherein the air flowing through the first air passage is dehumidified as moisture therein condenses on the second surface of the first plate;

a housing having first and second surfaces located on opposite sides and defining a first orifice, wherein the orifice is configured to receive and hold the thermoelectric cooler;

a pair of side panels mounted on the first surface of the housing and configured to rigidly hold the second plate thereto, wherein the first plate is mounted on the first surface of the housing between the pair of side plates, thereby forming an inlet and an outlet at a top side and a bottom side of the first air passage, respectively, wherein the inlet of the first air passage is disposed above the outlet of the first air passage causing the moisture condensed on the second surface of the first plate to flow to the outlet of the first air passage, and wherein the air circulating means is a fan that is further positioned to draw air from the outlet of the first passage during operation of the fan;

a back panel disposed apart from the second plate, wherein the fan is mounted on the back panel;

a top panel configured to connect a top side of the second plate to a top side of the back panel;

a bottom panel configured to connect a bottom of the back panel to the housing below the first plate;

the two side panels further configured to be connected to the back panel, the top panel, and the bottom panel, to thereby form an outer air passage and to thereby force the air to flow toward the fan in the first and second air passages when the fan is in operation;

a movable door, wherein the back panel further defines an additional air intake opening configured to mount the movable door, wherein the movable door is moved to open or close the additional air intake opening;

a control device including at least one of a fan control device configured to control the speed of the fan, a door control device configured to move the movable door, and a TEC power supply control device configured to control power supply to the thermoelectric cooler; and a controller configured to send controlling signals to the control device for controlling the operation of the dehumidifier, to thereby optimally control the operation of the dehumidifier.

11. A beverage dispenser comprising:

a chamber having a plurality of side walls and configured to store beverage making powders; and a dehumidifier mounted on one of the side walls of the chamber, the humidifier comprising:

a thermoelectric cooler having first and second ends on opposite sides, with the first end being cooler than the second end during operation;

a first plate which is thermally conductive and has first and second surfaces on opposite sides, wherein the first surface is thermally coupled to the first end of the thermoelectric cooler;

a second plate spaced from and facing the second surface of the first plate to form a first air passage therebetween; and an air circulating means for causing air to flow through the first air passage, wherein the air flowing through the first air passage is dehumidified as moisture therein condenses on the second surface of the first plate.

12. The dehumidifier of the beverage dispenser of claim 11 further comprising a thermally conductive buffer block disposed between the first end of the thermoelectric cooler and the first plate.

13. The dehumidifier of the beverage dispenser of claim 12 wherein the buffer block is substantially made of copper and imparts a spacing between the first end of the thermoelectric cooler and the first plate.

14. The dehumidifier of the beverage dispenser of claim 11 further comprising:

a housing having first and second surfaces located on opposite sides and defining a first orifice, wherein the orifice is configured to receive and hold the thermoelectric cooler; and a pair of side panels mounted on the first surface of the housing and configured to rigidly hold the second plate thereto, wherein the first plate is mounted on the first surface of the housing between the pair of side plates, thereby forming an inlet and an outlet at a top side and a bottom side of the first air passage, respectively, wherein the inlet of the first air passage is disposed above the outlet of the first air passage causing the moisture condensed on the second surface of the first plate to flow to the outlet of the first air passage, and wherein the air circulating means is a fan that is positioned to draw air from the outlet of the first passage during operation of the fan.

15. The dehumidifier of the beverage dispenser of claim 14 further comprising:

a back panel disposed apart from the second plate, wherein the fan is mounted on the back panel;

a top panel configured to connect a top side of the second plate to a top side of the back panel; and a bottom panel configured to connect a bottom of the back panel to the housing below the first plate; and the two side panels further configured to be connected to the back panel, the top panel, and the bottom panel, to thereby form an outer air passage and to thereby force the air to flow toward the fan in the first and second air passages when the fan is in operation.

16. The dehumidifier of the beverage dispenser of claim 15 further comprising a third plate disposed between the back panel and the second plate to create a second air passage between the second plate and the third plate.

17. The dehumidifier of the beverage dispenser of claim 16 wherein the housing further defines a second orifice located between the bottom of the first plate and above where the bottom plate is connected to the housing; and wherein the second orifice is filled up with a material that allows water to sip therethrough while preventing air from flow therethrough.

18. The dehumidifier of the beverage dispenser of claim 17 wherein the material is a piece of wicking fabric.

19. The dehumidifier of the beverage dispenser of claim 15 further comprising a movable door, wherein the back panel further defines an additional air intake opening configured to mount the movable door, wherein the movable door is moved to open or close the additional air intake opening.

20. The dehumidifier of the beverage dispenser of claim 19 further comprising:

a control device including at least one of a fan control device configured to control the speed of the fan, a door control device configured to move the movable door, and a TEC power supply control device configured to control power supply to the thermoelectric cooler; and a controller configured to send controlling signals to the control device for controlling the operation of the dehumidifier, to thereby optimally control the operation of the dehumidifier.

21. A method of dehumidifying a chamber that stores beverage making powder, the method comprising the steps of:

drawing air from inside of the chamber;

flowing the drawn air on a cold surface to cause moisture in the air to condense thereon, thereby dehumidifying the air;

returning the dehumidified air to the chamber;

collecting the moisture formed on the cold surface;

passing the collected moisture to outside of the chamber through a conduit; and preventing air from the outside to enter the chamber through the conduit to thereby ensure low humidity within the chamber.

22. The method of claim 21 further comprising the step of:

controlling an air flow speed on the cold surface, to thereby maintain the humidity inside the chamber within a predetermined range.

23. The method of claim 22 wherein the predetermined humidity range is between about 28% and 60%.

24. The method of claim 22 further comprising the steps of:

measuring the temperature and humidity of the air inside the chamber; and automatically controlling the airflow speed according to the measured temperature and humidity for maintaining the air inside the chamber at predetermined ranges of temperature and humidity.

25. The method of claim 21 further comprising the step of:

cooling a heat sink of the cold surface for maintaining the cold surface at a lower temperature than that of the air inside the chamber.

26. A method of dehumidifying a chamber that stores a beverage-making powder, which method comprises the steps of:

drawing air from inside of the chamber;

flowing the drawn air on a cold surface through a passage arranged so as to pass air in a direction substantially parallel to the cold surface to cause moisture in the air to condense thereon, thereby dehumidifying the air;

returning the dehumidified air to the chamber; and collecting the moisture formed on the cold surface.

* * * * *